US011229826B1

(12) United States Patent
Klein

(10) Patent No.: US 11,229,826 B1
(45) Date of Patent: Jan. 25, 2022

(54) DUAL-WEDGE SWIM PLATFORM WITH ROTATING HANDLEBARS

(71) Applicant: Scott Alexander Klein, Shawnee, KS (US)

(72) Inventor: Scott Alexander Klein, Shawnee, KS (US)

(73) Assignee: Scott Alexander Klein, Shawnee, KS (US)

( * ) Notice: Subject to any disclaimer, the term of this patent is extended or adjusted under 35 U.S.C. 154(b) by 0 days.

(21) Appl. No.: 17/071,099

(22) Filed: Oct. 15, 2020

(51) Int. Cl.
*A63B 31/00* (2006.01)
*A63K 3/02* (2006.01)

(52) U.S. Cl.
CPC ..... *A63B 31/00* (2013.01); *A63K 3/023* (2013.01); *A63B 2225/09* (2013.01); *A63B 2244/20* (2013.01)

(58) Field of Classification Search
CPC ..... A63B 31/00–18; A63B 69/12–14; A63B 2244/203; A63B 3/02; A63B 3/023
See application file for complete search history.

(56) References Cited

U.S. PATENT DOCUMENTS 1,785,968 A * 12/1930 Nicholson ..... A63K 3/023 482/19
5,645,516 A * 7/1997 Foster ..... A63B 21/0004 482/121
6,494,812 B1 * 12/2002 Grimes, Jr. ..... A63B 5/00 482/14
10,780,367 B2 * 9/2020 Henry ..... F16H 31/002
2004/0086693 A1 * 5/2004 Saldarelli ..... E04F 15/02161 428/172
2006/0137287 A1 * 6/2006 Svendsen ..... F16B 2/04 52/698
2009/0171229 A1 * 7/2009 Saldarelli ..... A63B 69/12 600/523
2013/0095980 A1 * 4/2013 Solanyk ..... A63B 5/10 482/55
2013/0252788 A1 * 9/2013 Kaiel ..... A63K 3/023 482/55
2015/0190665 A1 * 7/2015 Drozdowski ..... A63K 3/023 4/496
2016/0114238 A1 * 4/2016 Santino, Jr. ..... A63B 5/10 340/4.13
2019/0366227 A1 * 12/2019 Henry ..... F16H 31/002

OTHER PUBLICATIONS

FINISSwimBlockTrackStart "https://www.amazon.com/FINIS-Swim-Track-Start/dp/B07VDRC33R/ref=asc_df_B07VDRC33R/?tag=hyprod20&linkCode=df0&hvadid=475811639986&hvpos=&hvnetw=g&hvrand=12299494206018857755&hvpone=&hvptwo=&hvqmt=&hvdev=c&hvdvcmdl=&hvlocint=&hvlocphy=1027027&hvtargid=pla-1189410158868&psc=1" (Year: 2020).*

* cited by examiner

*Primary Examiner* — Nyca T Nguyen

(57) ABSTRACT

A swim platform with a higher level of performance offered by an increase in the horizontal velocity and force off of the swim platform, thus enabling the athlete to enter the water further from the start. The athlete having full control over adjustments can create an optimal setup for their specifications.

6 Claims, 1 Drawing Sheet

DUAL-WEDGE SWIM PLATFORM WITH ROTATING HANDLEBARS

At the beginning of a swim race, the athlete experiences their greatest velocity. Traditional swim platforms primarily provide support for the back foot of the athlete, leaving the front foot with minimal support and no advantage. Some of these swim platforms include handlebars to further increase velocity off the start but are only available in one position which has a low comfort level.

The swim platform following the current guidelines provided by FINA, USA Swimming, and the NCAA. The single wedge platform improved most aspects of the start of competitive races. Track starting blocks have also been proven to increase aspects of track athletes starts. These blocks have been used for decades.

The two wedges on the track blocks are completely independent of the other, allowing individuals to completely adjust the wedges to meet their criteria and comfort levels.

The wedges are lockable when in any position so that when under extreme forces from athletes, they do not move or slide. The handlebars on current swim platforms are more of a preference for most athletes as they currently do not provide a substantial increase towards starting aspects.

BACKGROUND

Swim platforms have seen little innovation in the past several decades. In the 2012 London Olympic Games, the single wedge was introduced to the starting platform for swimming. The wedge is a second platform provided for the athlete's back foot that has a steeper angle than the rest of the platform that stretched the entire width of the platform. Most competitive pools that host meets now use the wedge as their primary platform.

The lead foot of the swimmer provides the most force to accelerate off the platform. The lead foot is also on the platform from 0.1 to 0.5 seconds longer than the back foot from the reaction time at the college and professional level meaning that the lead foot is the most important foot off of the start. The lead foot is currently pushing off of the thin front edge, hindering its output force.

The ball of the foot (the metatarsophalangeal joint) outputs the most force, but currently, the lead foot's force is coming from the toes, leaving the ball elevated from the platform. This can severely limit the front foot's capabilities.

Handlebars were introduced to the wedge swim platform shortly after the wedge. The handlebars are elevated from the platform and parallel to the center axis of the platform. At the college and professional levels, not every athlete uses the handlebars as they are not comfortable. These handlebars have not proven to be beneficial nor restraining, hence the split between usage and lack thereof.

SUMMARY OF THE INVENTION

Embodiments of the technology concern a method and apparatus for improving an athlete's bodily position to increase the net direction of force in the horizontal direction and the efficiency of the start. This is obtained by two wedges completely independent of the other and fully adjustable the entire length of the swim platform. In some embodiments, the wedges are a part of the swim platform but can be fully removed and are interchangeable with the other. The platform also includes at least one handlebar lockable in the forward position, parallel to the center axis of the platform, and free moving when in the inward position. In some embodiments, the platform includes a pair of handlebars completely independent of the other.

BRIEF DESCRIPTION OF THE DRAWINGS

Embodiments of the present technology are described in detail below with reference to the attached drawing figures, wherein.

DETAILED DESCRIPTION

Figure 1:
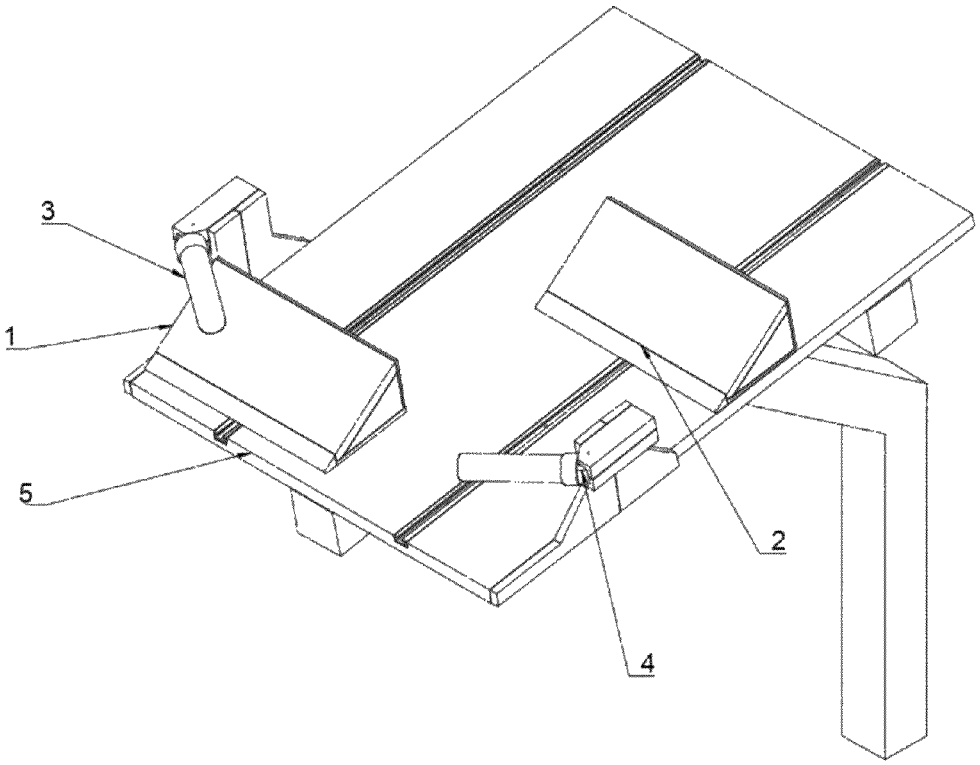
FIG. 1 is a perspective view of a swim platform in accordance with the present invention. Handlebars are shown in an inward, free-moving, position. Two wedges are shown in a configuration that would likely be used by an athlete who is dominant in the right foot. A base frame is shown with the swim platform and is shown supporting the platform.
Figure 2:
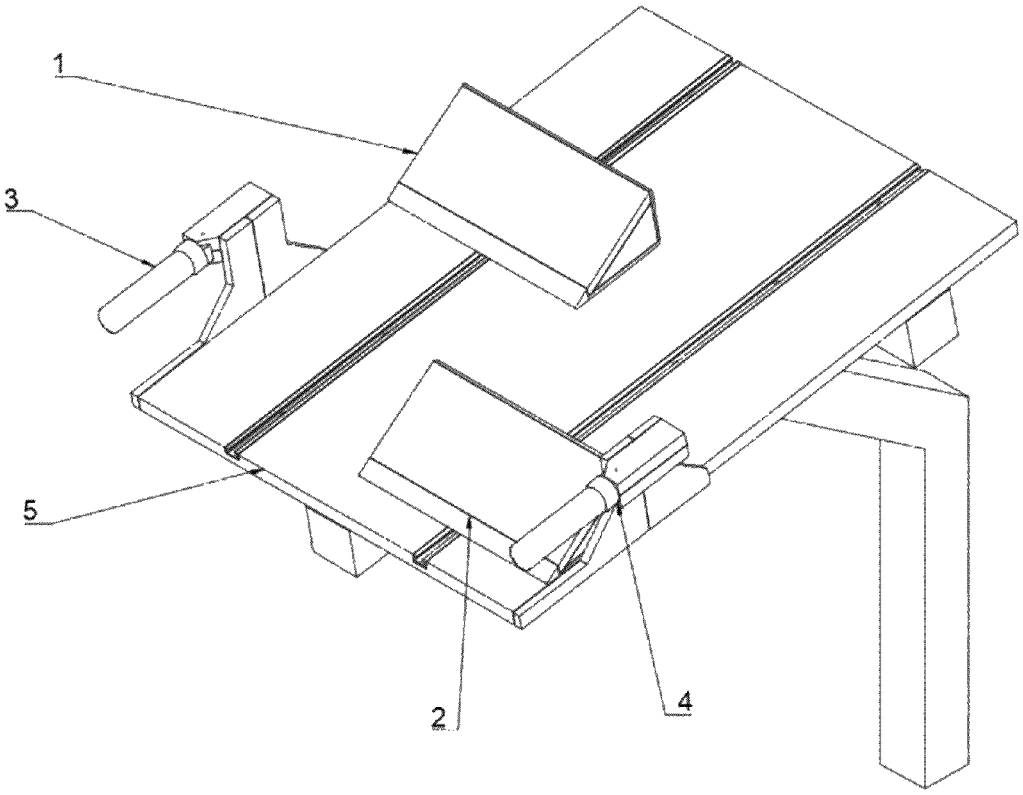
FIG. 2 is a perspective view of the swim platform illustrated in FIG. 1 with the handlebars shown in a forward, locked, position, parallel to the center axis of the swim platform. The two wedges are shown in a configuration that would likely be used by an athlete who is dominant in the left foot.

One embodiment of an improved swim platform (1) is shown in FIG. 1 and includes a top surface (2), a first wedge (3), a second wedge (4), and handlebars (5) and (6). The top surface 2 is operable to support a swimmer above the water and having a center axis (7). The first wedge 3 is removably attachable to the top surface 2 and adjustable along the length of the center axis 7 of the top surface 2. The second wedge 4 is removably attachable to the top surface 2 and adjustable along the length of the center axis 7 of the top surface 2. The first wedge 3 and the second wedge 4 can be locked in a single position, such as the front, middle, back, or anywhere in between, but unlocked to adjust to a different position along the swim platform 1. As shown in FIG. 1, the first wedge 3 is in a front position, while the second wedge 4 is in a middle position on the swim platform 1. As shown in FIG. 2, the first wedge 3 is in a middle position, while the second wedge 4 is in a front position on the swim platform 1. The first wedge 3 and the second wedge 4 are interchangeable with the other. The angle of the first wedge 3 and the second wedge 4 are restricted to an angle with the range of 20 degrees and 60 degrees and supported along the slope of the platform 1, generally at 10 degrees as shown in FIGS. 1 and 2.

The top surface 2, the first wedge 3, and the second wedge 4 can be made of metal like aluminum or steel, strong plastic, plywood, or other materials with low flexibility. The material of the top surface 2 is to be made of or applied with a non-slip surface (10) similar to grip tape, 80 grit sandpaper, or rough plastic, similar to a running track surface. The first wedge 3 and second wedge 4 are to have a non-slip surface 10 as well.

As shown in FIG. 2, the handlebars 5 and 6 are parallel to the center axis 7 of the top surface 2 when in their locked position (8). As shown in FIG. 1, the handlebars 5 and 6 are able to be rotated toward the center axis 7 of the top surface 2 when not in their locked position 8 and free moving in an inward position (9). When in the inward position 9, the handlebars 5 and 6, although free-moving, are at an angle within a range of 45 degrees and 75 degrees, where the angle cannot be exceeded. The handlebars 5 and 6, when in their free-moving position 9 can be rotated back towards the locked position 8 with minimal friction. The material of the handlebars 5 and 6 should generally be metal like aluminum or steel but can have a rubber- or foam-like non-slip material.

The invention claimed is:

1. A swim platform comprising:

a top surface operable to support a swimmer above the water and having a center axis;

a first wedge removably attachable to the top surface and adjustable along the length of the center axis of the top surface;

a second wedge removably attachable to the top surface and adjustable along the length of the center axis of the top surface independent of the adjustment of the first wedge;

and at least one handlebar mounted to the top surface and adjustable between a first position wherein the handlebar is generally parallel to the center axis and a second position wherein the handlebar defines an acute angle relative to the center axis;

said handlebar being lockable in the first position but moveable when in the second position.

2. The swim platform of claim 1, wherein the wedges are generally triangular in shape and form an obtuse angle with the top surface.

3. The swim platform of claim 2 wherein the internal acute angle of the wedges are within a range of 20 degrees and 60 degrees.

4. The swim platform of claim 1, wherein the acute angle of the handlebar is within a range of 45 degrees and 75 degrees.

5. The swim platform of claim 1, further comprising a second handlebar mounted to the top surface and adjustable between a first position wherein the second handlebar is generally parallel to the center axis and a second position wherein the second handlebar defines an acute angle relative to the center axis.

6. The swim platform of claim 1, wherein the first and second wedges are independent and are interchangeable with each other.

* * * * *